United States Patent [19]

Bratt et al.

[11] Patent Number: 4,991,492

[45] Date of Patent: Feb. 12, 1991

[54] HYDROSTATIC AXIAL PISTON MACHINE

[76] Inventors: Stig Bratt, Myrgangen 56, S-461 62 Trollhättan; Torby Malmros, Bergkullevägen 390, S-461 67 Trollhättan, both of Sweden

[21] Appl. No.: 442,262

[22] Filed: Nov. 28, 1989

[30] Foreign Application Priority Data

Nov. 30, 1988 [SE] Sweden ..... 8804341

[51] Int. Cl.[5] ..... F01B 3/00; F01B 13/04

[52] U.S. Cl. ..... 92/12.2; 91/506; 417/222; 92/71

[58] Field of Search ..... 92/12.2, 71; 91/486, 91/487, 506; 417/222

[56] References Cited

U.S. PATENT DOCUMENTS

| | | | |
|---|---|---|---|
| 3,554,095 | 1/1971 | Bobst | 91/486 X |
| 3,967,541 | 7/1976 | Born et al. | 91/506 X |
| 4,543,876 | 10/1985 | Heyl et al. | 417/222 X |
| 4,827,833 | 5/1989 | Heyl et al. | 91/506 X |
| 4,893,549 | 1/1990 | Forster | 92/12.2 |

*Primary Examiner*—Allen M. Ostrager
*Attorney, Agent, or Firm*—Pollock, Vande Sande and Priddy

[57] ABSTRACT

A variable displacement hydrostatic axial piston machine has a cylinder barrel which is rotatable in a yoke and has a plurality of circumferentially spaced cylinder bores in which are mounted pistons which with the ends of their associated piston rods are journalled in a drive disk on a machine shaft rotatably mounted in the casing of the machine. The yoke is mounted in said casing pivotable about a transfer axis through the drive disk center by means of an adjustment device for varying the displacement and possibly also the mode of the operation of the machine, in the yoke and the machine casing furthermore being disposed a pair of hydraulic fluid connecting conduits. For obtaining a lighter and more compact design of the machine the yoke is formed with a guiding segment instead of another leg, said segment being adapted to be moved in a curved guide path in the casing located in a plane perpendicular to the pivot axis of the yoke, one of the connecting conduits for hydraulic fluid to the cylinder barrel extending within said yoke leg while the other is formed by a hollow space in the machine casing, and the adjustment device comprises two cylinder bores in the yoke with adjustment pistons therein and an adjustment valve for selectively connecting one of said pair of adjustment cylinder bores with one of the hydraulic fluid conduits for adjusting the yoke.

7 Claims, 4 Drawing Sheets

Figure 1:
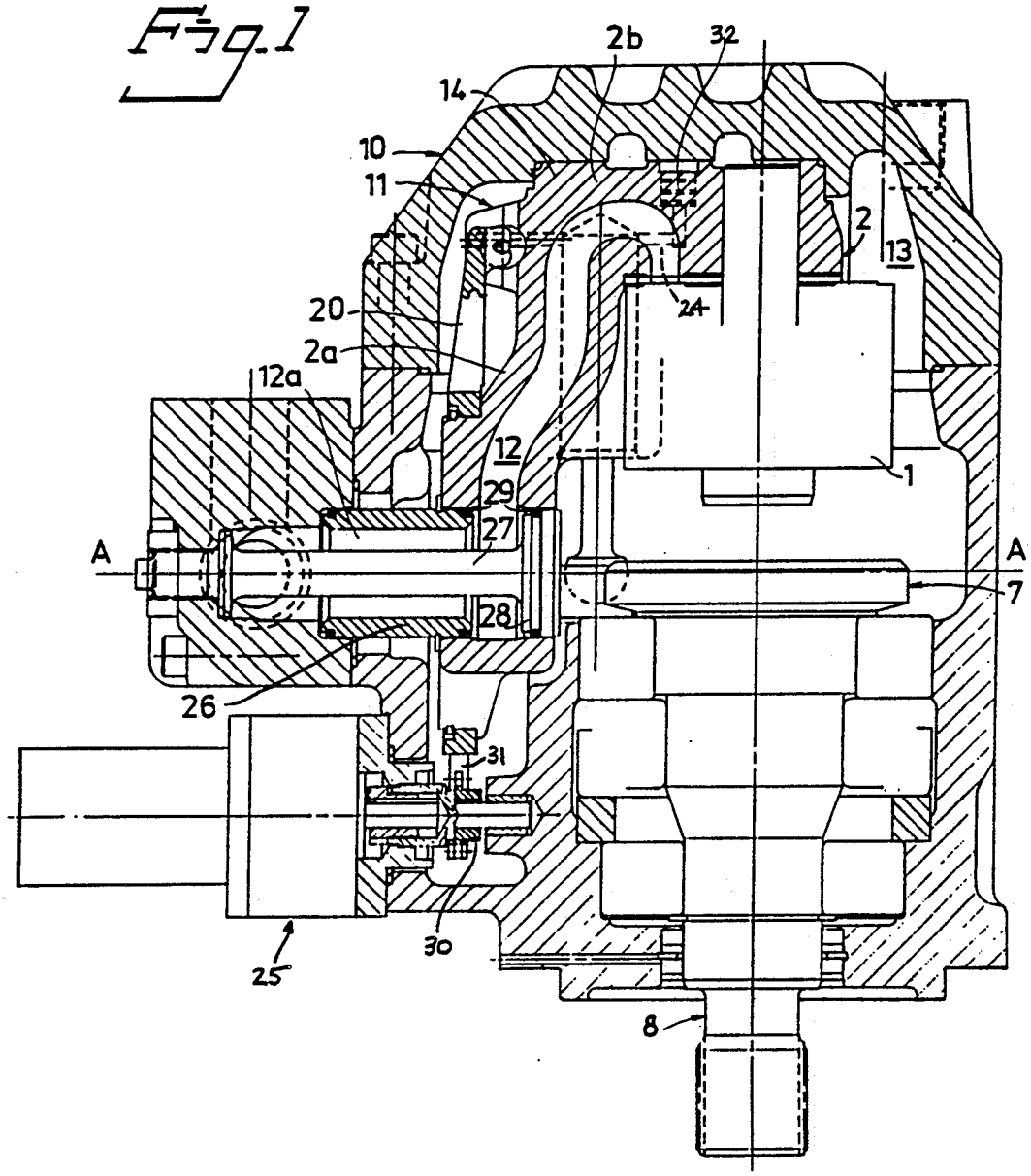

2b
32
14
10
11
2
13
24
20
2a
12a
12
29
27
1
A
A
7
28
26
31
30
25
8

HYDROSTATIC AXIAL PISTON MACHINE

The present invention refers to a variable displacement hydrostatic axial piston machine comprising a cylinder barrel, rotatably mounted in a yoke and housing a plurality of circumferentially spaced cylinder bores, in which are mounted reciprocally movable pistons with associated piston rods, the free ends of which are journalled in a drive disk, a machine shaft with which the drive disk is rigidly connected and which is rotatably mounted in a machine casing, in which a leg of the yoke is pivotally journalled for reciprocatory swinging motions on a transverse axis through the drive disk center by means of an adjustment device in order to vary the displacement and possibly also the machine operating mode, a pair of connecting conduits for hydraulic liquid being situated in the yoke and the machine casing.

In axial piston machines with variable displacement the cylinder barrel is pivotally mounted for reciprocating movements relative to the drive disk by means of either a slide bearing in the form of a guiding segment which is slidably movable in a curved guide path in the machine casing, or by means of a yoke. In yoke-equipped machines it is previously known to arrange the two conduits for inlet and outlet of the hydraulic fluid adjacent each other on one of the legs of the yoke such that the other leg might be formed correspondingly smaller and thus, a space is saved at one side of the machine, see e.g. U.S. Pat. No. 3,065,711. When applying a variable displacement axial piston machine of the yoke-type for e.g. energy accumulation and recovery in connection with hydrostatic vehicle transmissions it has thus turned out to be desirable to try to provide a yoke design which makes the yoke smaller and lighter so that smaller masses need to be moved when varying the displacement of the machine. As a consequence the control of the displacement can be made more sensitive.

The object of the present invention is to provide an improved design of a hydrostatic axial piston machine of the kind referred to above, and the invention is substantially distinguished in that a guiding segment is substituted for a further yoke leg, said segment being mounted at the top or center portion of the yoke and adapted to move along a curved guide path in the machine casing, said guide path extending in a plane perpendicular to the pivot axis of the yoke, one of the connecting conduits extending within the yoke leg, while a hollow space within the machine casing forms the other conduit, and in that the adjustment device comprises two cylinder bores, formed in the yoke and preferably located equally spaced from a center plane of said yoke, an adjustment piston being mounted in each of said cylinder bores and having piston rods which are journalled with their ends in seats in the machine casing, an adjustment valve furthermore being provided to selectively connect one of said adjustment cylinder bores with one of the hydraulic conduits for carrying out yoke adjustment.

Owing to the invention the machine is still more compact in that no space for a yoke leg is required at one side of the machine. By the inventive yoke design the yoke is be lighter than prior art yokes and therefore the displacement control inertia will be reduced. Another advantage is that the yoke adjustment device in the form of a pair of adjustment cylinders incorporated in the yoke further contributes to a more compact machine design and at the same time the function of the adjustment device becomes fast and exact.

Figure 2:
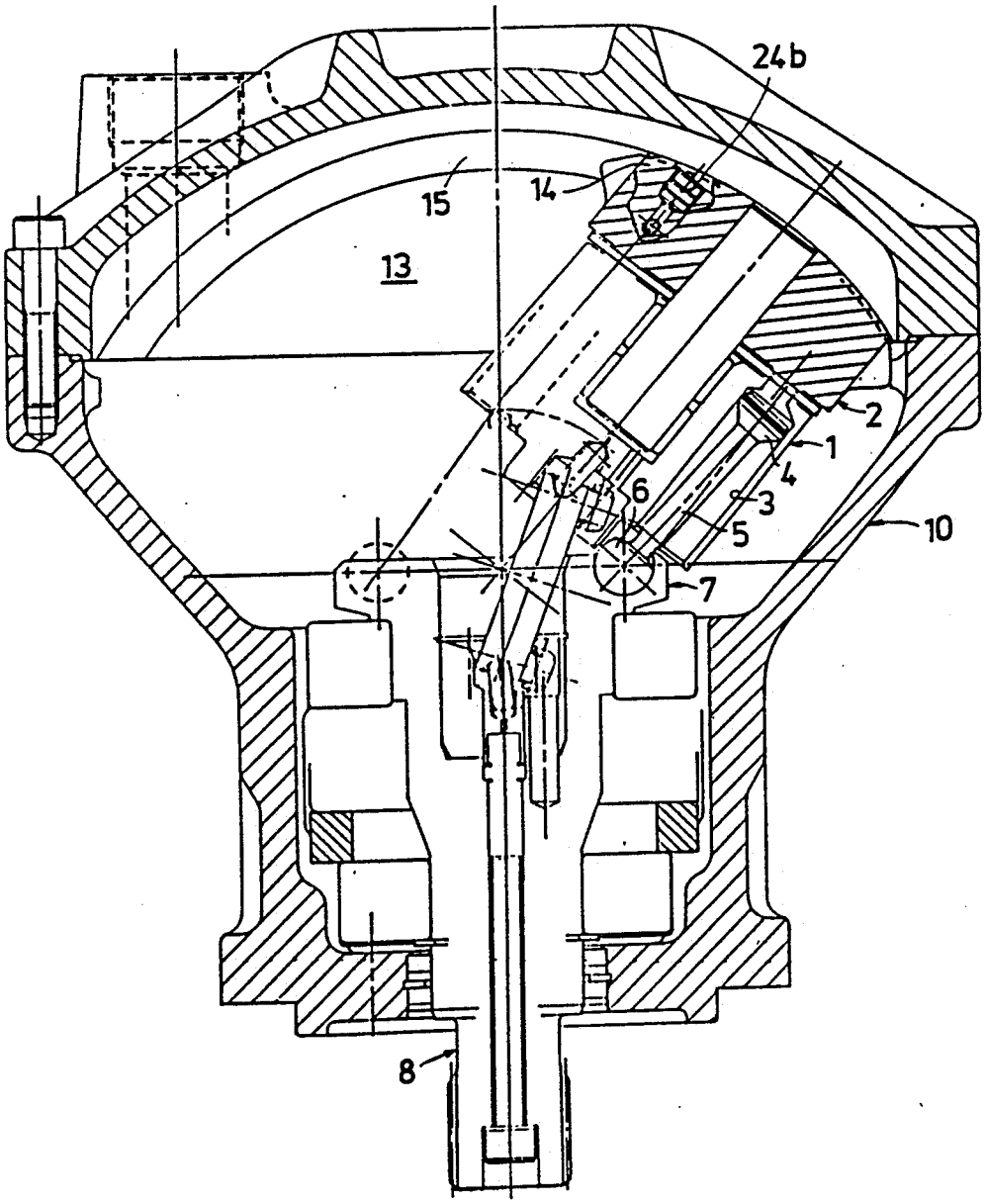
Figure 3:
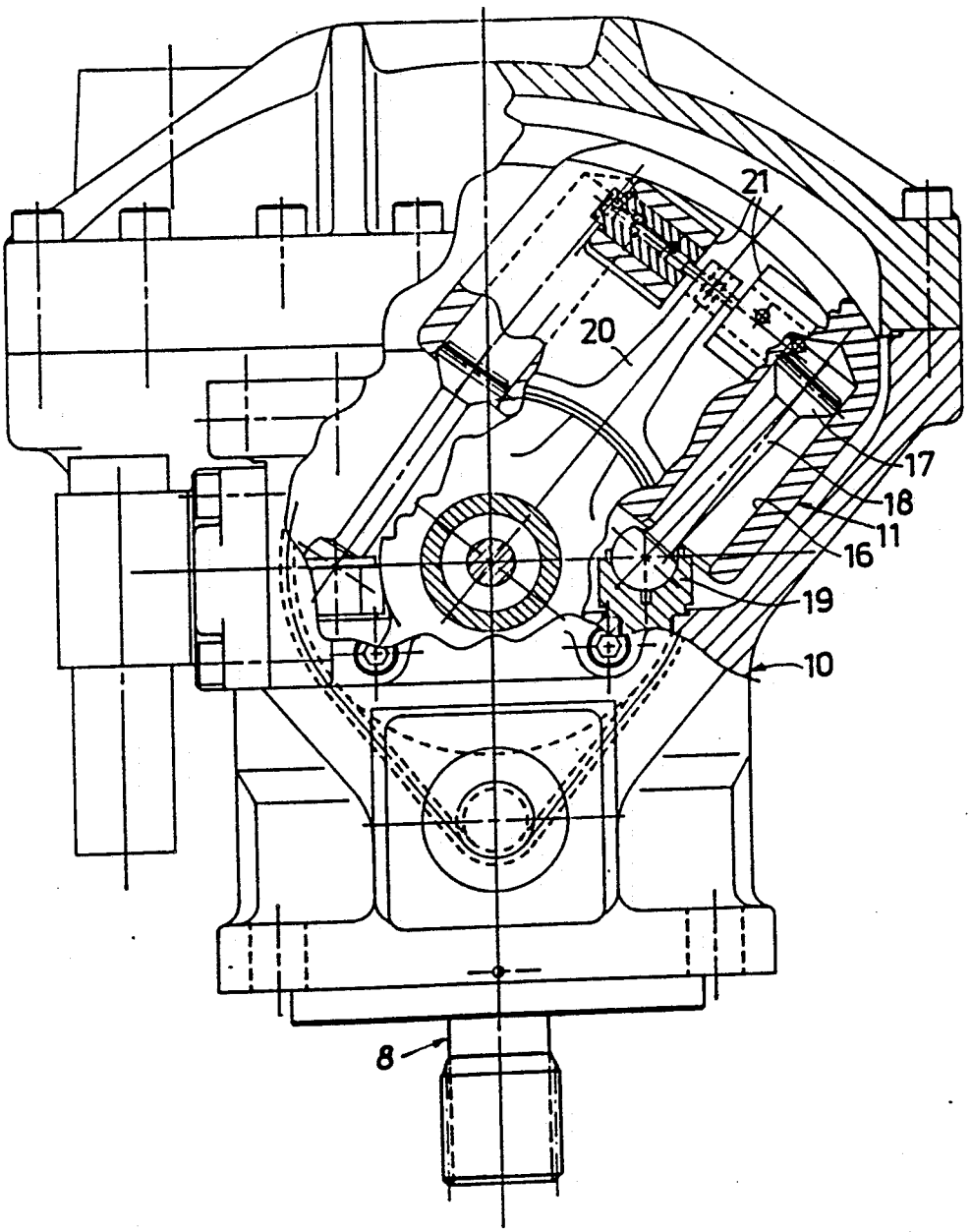
Figure 4:
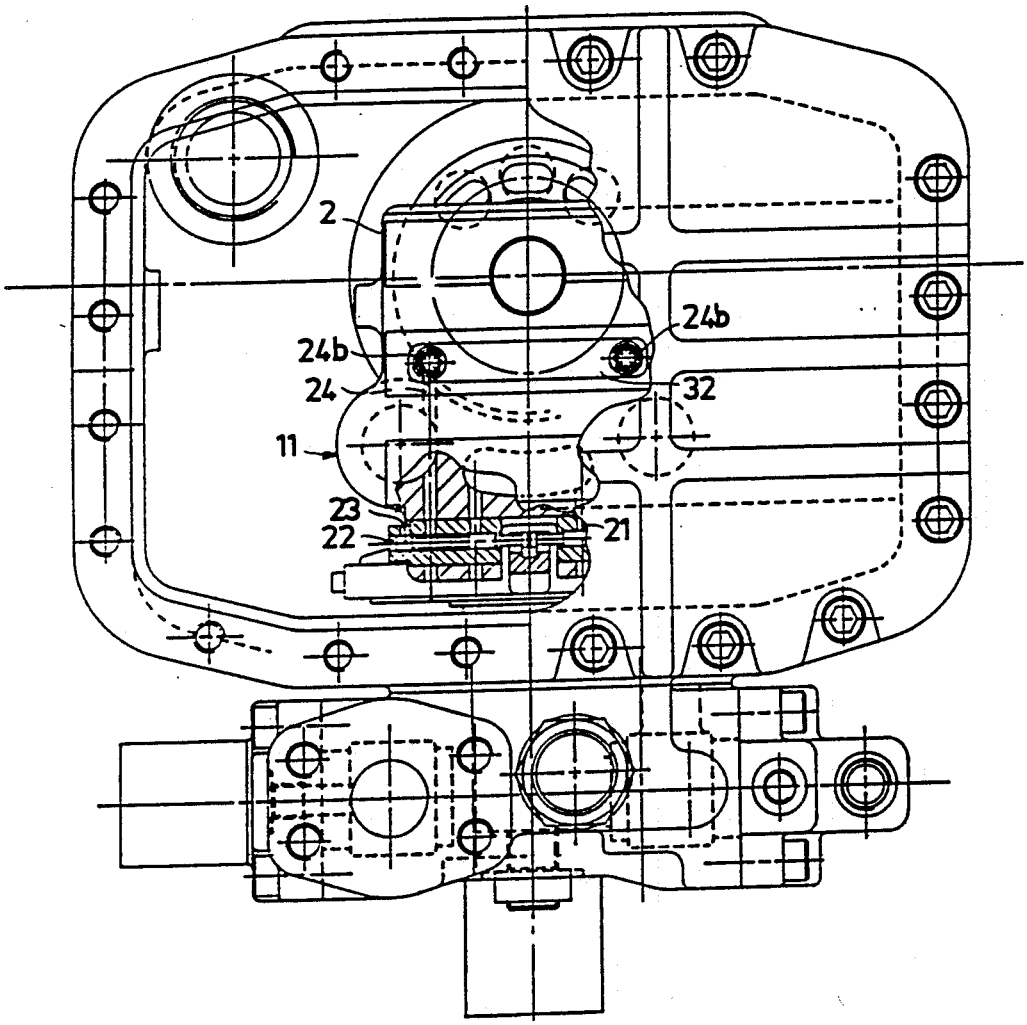

By way of example the invention will be further described below with reference to the accompanying drawing in which FIG. 1 is a side elevational view partly in section of an axial piston machine according to the invention, FIG. 2 is a cross-section of the machine according to FIG. 1, taken in the plane of the machine shaft, FIG. 3 is a front view of the machine, partly in section on one hand through the plane containing the center axis of the adjustment valve device in the yoke and partly through the center plane of one of the adjustment cylinders, and FIG. 4 is a partly sectioned top plane view of the machine.

As illustrated in the drawing a hydrostatic axial piston machine with variable displacement comprises a cylinder barrel 1, which is rotatably mounted in a yoke 2. The barrel 1 houses a plurality of circumferentially spaced cylinder bores 3, e.g. nine bores, in which pistons 4 are mounted for reciprocatory motion. Each piston 4 is rigidly secured to and preferably made integral with an associated piston rod 5, the opposite spherical end 6 of which is journalled in a known manner in a drive disk 7, which is rigidly secured to a machine shaft 8.

By a leg *2a* the yoke 2 is mounted in a machine casing 10 so as to be reciprocatory swingable about a transverse axis A—A through the center of the drive disk 7 by means of an adjustment device 11 for varying the displacement and in the present case also for shifting the functional mode of the machine between pump and motor. Furthermore, in the yoke 2 and the machine casing 10 there is provided a pair of connection conduits 12, 13 for hydraulic fluid.

The other leg of the yoke 2 is totally omitted is the design according to the present invention and replaced by a guiding segment 14 on the top or center portion *2b* of the yoke, and said segment is adapted for running in a curved guide path 15 provided in the machine casing in a plane perpendicular to the pivot axis A—A of the yoke 2. As known, one of the connection conduits 12 for hydraulic fluid to the cylinder barrel 1 is disposed in the yoke leg *2a*, while the other is formed by the hollow space 13 within the machine casing 10. In the present case, in the application in connection with hydrostatic transmission as primarily intended, the machine is thought to work with permanently the same high pressure side for the hydraulic fluid, the connection conduit 12 thus being adapted to admit fluid at high pressure, namely of the order of magnitude of up to about 400 bar, when the machine operates as motor, while the outlet from the respective cylinder bores 3 thus occurs freely out into the hollow space 13 in the machine casing 10, in which a low pressure of about a few bars preferably is maintained. When the machine operates as pump the opposite direction of flow is obtained and the high pressure side still is maintained in the conduit 12.

According to the invention the adjustment device 11 for the pivotal movement of the yoke 2 is constituted by two preferably parallel cylinders 16 made in the yoke 2 at either side of the yoke leg *2a*, i.e. with equal spacing from the center plane of the yoke. In said cylinders 16 are slidably arranged adjustment pistons 17 and the ends of their associated piston rods 18 are journalled in seats 19 in the machine casing 10. The adjustment device 11 also comprises a shifting valve 21 for selectively connecting one of the two adjustment cylinders 16 with said one hydraulic fluid conduit 12 for adjustment of the yoke 2.

In a preferred embodiment of the invention the shifting valve is made as a piston valve 21, the piston 22 of which is axially movable by means of an actuating means 20. In its axial movement in one direction or the other from a neutral central position, the piston 22 is adapted to connect one of the adjustment cylinders 16 with the hydraulic fluid conduit 12 in the yoke *2a*, at the same time as the other cylinder 16 is connected with a hydraulic fluid outlet 23 in the valve 21. In the embodiment of this valve 21 illustrated in FIG. 4 the outlet 23 opens directly into the hollow space 13 in the machine casing 10.

The illustrated embodiment of the machine with a slide bearing in the casing 10 and a high pressure servo for the adjusting movement in the form of the above-described adjustment device 11 provides, however, an advantageous possibility to obtain a pressure balancing of said bearing. In addition to the above-stated outlet 23 in the piston valve 21 there might namely be arranged adjacent to either one thereof in the center portion *2b* of the yoke a pressure passage 24 opening into a balancing groove 32 on the surface of the guiding segment 14. Said passages 24 each include a check valve *24b* (or alternatively, a common, not illustrated shift valve or two separate balancing surfaces). Owing thereto the drawback otherwise present in slide bearings or segment guidings can be avoided, namely the great friction in the bearing due to the high load on the hydraulic fluid pressure which implies poor control characteristics. The advantage of the foregoing pressure-balanced embodiment is that a hydrostatic bearing of the segment is obtained, which is supplied with pressure oil only when the yoke 2 is to be adjusted. For the rest the segment guiding is non-pressurized and thereby the risk for detrimental leakages are reduced.

The means for actuation of the valve piston 22 might advantageously be constituted by an actuation lever 20, which is mounted for pivotal motion about the pivot axis A—A of the yoke 2 and with its free end connected with the valve piston 22. In a preferred embodiment of the invention the actuation lever 20 is pivotable by means of a drive device 25, particularly in the form of an electric motor. Said motor may be a conventional electric motor with suitable gearing or a step motor. The motor shaft is connected with the actuation lever 20 in a suitable way, in the present case through a sprocket 30 secured to the motor shaft, over which sprocket a chain portion 31 is laid, which is secured with its ends to diametrically opposite positions on the actuation lever 20 at the bearing thereof about the yoke pivot axis A—A. The actuation lever 20 implies that the piston valve 21 in the normal case forms a sensitive follow servo which does not require great actuating load on the actuation lever. Should hydraulic fluid high pressure not be available the actuation lever alone might be utilized, however, to provide mechanically a desired pivotal motion of the yoke 2.

In FIG. 1 of the drawing it has also been illustrated that the connecting conduit 12 for hydraulic fluid which passes to the yoke 2 through the leg *2a* thereof comprises an annular conduit portion *12a* located coaxially with the pivot axis A—A of the yoke. Outwardly said annular conduit portion is defined by a tubular member 26 which is connected with the machine casing 10 and inwardly said annular conduit portion is defined by a yoke support shaft 27, which shaft also is secured to the casing 10 and at its free end is formed with a circular end plate 28. Said plate has substantially the same diameter as the outer diameter of the tubular member 26 and is located at a spacing from the free end thereof, which substantially corresponds to the cross-sectional dimension of the passage 12 as seen in the direction of said pivot axis A—A. In this case the leg *2a* of the yoke is rotatably supported by the tubular member 26 and by the shaft end plate 28 and sealed thereagainst by means of suitable sealing rings 29. Owing to said annular conduit portion *12a* there can be obtained a pressure balancing of the yoke support shaft 27.

We claim:

1. A variable displacement hydrostatic axial piston machine comprising a cylinder barrel rotatably mounted in a yoke and housing a plurality of circumferentially spaced cylinder bores in which are mounted reciprocally movable pistons with associated piston rods, the free ends of said piston rods being journalled in a drive disk, a machine shaft with which the drive disk is rigidly connected and which is rotatably mounted in a machine casing, the yoke including a leg which is pivotally journalled for reciprocatory swinging motions on a transverse axis through the drive disk center by means of an adjustment device in order to vary the displacement of the machine, a pair of connecting conduits for hydraulic liquid situated in the yoke and the machine casing, a guiding segment mounted on the yoke and adapted to move along a curved guide path in the machine casing, said guide path extending in a plane perpendicular to the pivot axis of the yoke, one of said pair of connecting conduits extending within the yoke leg, a hollow space within the machine casing forming the other conduit, said adjustment device comprising two cylinder bores formed in the yoke and located substantially equally spaced from a center plane of said yoke, an adjustment piston mounted in each of said cylinder bores and having piston rods which are journalled with their ends in seats in the machine casing, and an adjustment valve adapted to selectively connect one of said adjustment cylinder bores with one of said conduits for carrying out yoke adjustment.

2. A machine according to claim 1, wherein the adjustment valve is constituted by a piston valve, the piston of which is axially movable by means of an actuating means and adapted to connect in its axial movement in either direction from a neutral central position one of said adjustment cylinder bores with the hydraulic fluid conduit located in the yoke leg and the other with a hydraulic fluid outlet in the valve.

3. A machine according to claim 2, wherein said fluid outlet opens directly into the hollow space in said machine casing.

4. A machine according to claim 2 wherein said fluid outlet is connected with said hollow space in the machine casing through a pressure passage through the center portion of the yoke, said pressure passage opening on the surface of the guiding segment, each of the pressure passages including a valve common to both of the passages.

5. A machine according to any one of claim 2—4 wherein said actuating means is constituted by an actuating lever which is mounted pivotally about the yoke pivot axis and has a free end which is connected with the valve piston.

6. A machine according to claim 5, wherein said actuating lever is pivotable by means of an electric drive device.

7. A machine according to any one of claims 2—4 wherein the hydraulic fluid connecting conduit leading to the yoke through the leg thereof comprises an annular conduit passage coaxial with the yoke pivot axis and outwardly defined by a tubular member which is connected with the machine casing and inwardly defined by a yoke shaft also secured to the casing, the free end of the yoke shaft being formed with a circular end plate which has a substantially the same diameter as the outer diameter of the tubular member and which is located at a spacing from the free end of said tubular member which substantially corresponds to the cross-sectional dimension of the conduit in the axial direction, the yoke leg being rotatably supported by the tubular member and the shaft end plate and being sealed thereagainst by sealing means.

* * * * *